US006383092B1

(12) United States Patent
Ogg

(10) Patent No.: US 6,383,092 B1
(45) Date of Patent: May 7, 2002

(54) GOLF BALL WITH PYRAMIDAL PROTRUSIONS

(75) Inventor: Steven S. Ogg, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 09/442,860

(22) Filed: Nov. 18, 1999

(51) Int. Cl.[7] ..... A63B 37/12
(52) U.S. Cl. ..... 473/378
(58) Field of Search ..... 473/378, 384, 473/6.14

(56) References Cited

U.S. PATENT DOCUMENTS

| | | | | | |
|---|---|---|---|---|---|
| D29,949 | S | * | 1/1899 | Barnes | 473/378 |
| 1,517,514 | A | | 12/1924 | Hunt | |
| 2,002,726 | A | | 5/1935 | Young | |
| D107,066 | S | * | 4/1937 | Cavignac | 473/378 |
| 3,227,456 | A | | 1/1966 | Sonneman | |
| 4,090,716 | A | | 5/1978 | Martin et al. | |
| 4,266,773 | A | | 5/1981 | Treadwell | |
| 4,787,638 | A | | 11/1988 | Kobayashi | |
| 4,830,378 | A | * | 5/1989 | Aoyama | 473/382 |
| 4,836,552 | A | * | 6/1989 | Puckett et al. | 473/378 |
| 5,062,644 | A | | 11/1991 | Lee | |
| 5,064,199 | A | | 11/1991 | Morell | |
| 5,308,076 | A | | 5/1994 | Sun | |
| 5,441,276 | A | | 8/1995 | Lim | |
| 5,536,013 | A | | 7/1996 | Pocklington | |
| 5,575,477 | A | | 11/1996 | Hwang | |
| D393,671 | S | * | 4/1998 | Honaker | 473/416 |
| 5,857,924 | A | | 1/1999 | Miyagawa et al. | |
| 5,863,264 | A | | 1/1999 | Yamagishi et al. | |
| 5,906,551 | A | | 5/1999 | Kasashima et al. | |
| 5,908,359 | A | | 6/1999 | Shimosaka et al. | |
| 5,916,044 | A | | 6/1999 | Shimosaka et al. | |
| 5,935,023 | A | | 8/1999 | Machara et al. | |

* cited by examiner

*Primary Examiner*—Mark S. Graham
*Assistant Examiner*—Raeann Gordon
(74) *Attorney, Agent, or Firm*—Michael A. Catania

(57) ABSTRACT

A golf ball approaching zero land area is disclosed herein. The golf ball has an innersphere with a plurality of pyramidal projections. Each of the plurality of projections has an apex that extends to a height to conform with the 1.68 inches requirement for USGA approved golf balls. The plurality of pyramidal projections extend 0.005 inches to 0.015 inches from the innersphere surface. The outermost 0.002 inches of the golf ball has a minimal volume.

13 Claims, 6 Drawing Sheets

GOLF BALL WITH PYRAMIDAL PROTRUSIONS

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to an aerodynamic surface for a golf ball. More specifically, the present invention relates to a golf ball having pyramidal protrusions to effect turbulence during flight of the golf ball.

2. Description of the Related Art

Golfers realized perhaps as early as the 1800's that golf balls with indented surfaces flew better than those with smooth surfaces. Hand-hammered gutta-percha golf balls could be purchased at least by the 1860's, and golf balls with brambles (bumps rather than dents) were in style from the late 1800's to 1908. In 1908, an Englishman, William Taylor, received a British patent for a golf ball with indentations (dimples) that flew better ad more accurately than golf balls with brambles. A. G. Spalding & Bros., purchased the U.S. rights to the patent (embodied possibly in U.S. Pat. No. 1,286,834 issued in 1918) and introduced the GLORY ball featuring the TAYLOR dimples. Until the 1970s, the GLORY ball, and most other golf balls with dimples had 336 dimples of the same size using the same pattern, the ATTI pattern. The ATTI pattern was an octohedron pattern, split into eight concentric straight line rows, which was named after the main producer of molds for golf balls.

The only innovation related to the surface of a golf ball during this sixty year period came from Albert Penfold who invented a mesh-pattern golf ball for Dunlop. This pattern was invented in 1912 and was accepted until the 1930's. A combination of a mesh pattern and dimples is disclosed in Young, U.S. Pat. No. 2,002,726, for a Golf Ball, which issued in 1935.

The traditional golf ball, as readily accepted by the consuming public, is spherical with a plurality of dimples, with each dimple having a circular cross-section. Many golf balls have been disclosed that break with this tradition, however, for the most part these non-traditional golf balls have been commercially unsuccessful.

Most of these non-traditional golf balls still attempt to adhere to the Rules Of Golf as set forth by the United States Golf Association ("USGA") and The Royal and Ancient Golf Club of Saint Andrews ("R&A"). As set forth in Appendix III of the Rules of Golf, the weight of the ball shall not be greater than 1.620 ounces avoirdupois (45.93 gm), the diameter of the ball shall be not less than 1.680 inches (42.67 mm) which is satisfied if, under its own weight, a ball falls through a 1.680 inches diameter ring gauge in fewer than 25 out of 100 randomly selected positions, the test being carried out at a temperature of 23±1° C., and the ball must not be designed, manufactured or intentionally modified to have properties which differ from those of a spherically symmetrical ball.

One example is Shimosaka et al., U.S. Pat. No. 5,916,044, for a Golf Ball that discloses the use of protrusions to meet the 1.68 inch (42.67mm) diameter limitation of the USGA and R&A. The Shimosaka patent discloses a golf ball with a plurality of dimples on the surface a few rows of protrusions that have a height of 0.001 to 1.0 mm from the surface. Thus, the diameter of the surface is less than 42.67mm.

Another example of a non-traditional golf ball is Puckett et al., U.S. Pat. No. 4,836,552 for a Short Distance Golf Ball, which discloses a golf ball having brambles instead of dimples in order to reduce the flight distance to half of that of a traditional golf ball in order to play on short distance courses.

Another example of a non-traditional golf ball is Pocklington, U.S. Pat. No. 5,536,013 for a Golf Ball, which discloses a golf ball having raised portions within each dimple, and also discloses dimples of varying geometric shapes such as squares, diamonds and pentagons. The raised portions in each of the dimples of Pocklington assists in controlling the overall volume of the dimples.

Another example is Kobayashi, U.S. Pat. No. 4,787,638 for a Golf Ball, which discloses a golf ball having dimples with indentations within each of the dimples. The indentations in the dimples of Kobayashi are to reduce the air pressure drag at low speeds in order to increase the distance.

Yet another example is Treadwell, U.S. Pat. No. 4,266,773 for a Golf Ball, which discloses a golf ball having rough bands and smooth bands on its surface in order to trip the boundary layer of air flow during flight of the golf ball.

Aoyama, U.S. Pat. No. 4,830,378, for a Golf Ball With Uniform Land Configuration, discloses a golf ball with dimples that have triangular shapes. The total flat land area of Aoyama is no greater than 20% of the surface of the golf ball, and the objective of the patent is to optimize the uniform land configuration and not the dimples.

Another variation in the shape of the dimples is set forth in Steifel, U.S. Pat. No. 5,890,975 for a Golf Ball And Method Of Forming Dimples Thereon. Some of the dimples of Steifel are elongated to have an elliptical cross-section instead of a circular cross-section. The elongated dimples make it possible to increase the surface coverage area. A design patent to Steifel, U.S. Pat. No. 406,623, has all elongated dimples.

A variation on this theme is set forth in Moriyama et al., U.S. Pat. No. 5,722,903, for a Golf Ball, which discloses a golf ball with traditional dimples and oval shaped dimples.

A further example of a non-traditional golf ball is set forth in Shaw et al., U.S. Pat. No. 4,722,529, for Golf Balls, which discloses a golf ball with dimples and 30 bald patches in the shape of a dumbbell for improvements in aerodynamics.

Another example of a non-traditional golf ball is Cadorniga, U.S. Pat. No. 5,470,076, for a Golf Ball, which discloses each of a plurality of dimples having an additional recess. It is believed that the major and minor recess dimples of Cadorniga create a smaller wake of air during flight of a golf ball.

Oka et al., U.S. Pat. No. 5,143,377, for a Golf Ball, discloses circular and non-circular dimples. The non-circular dimples are square, regular octagonal, regular hexagonal and amount to at least forty percent of the 332 dimples on the golf ball of Oka. These non-circular dimples of Oka have a double slope that sweeps air away from the periphery in order to make the air turbulent.

Machin, U.S. Pat. No. 5,377,989, for Golf Balls With Isodiametrical Dimples, discloses a golf ball having dimples with an odd number of curved sides and arcuate apices to reduce the drag on the golf ball during flight.

Lavallee et at., U.S. Pat. No. 5,356,150, discloses a golf ball having overlapping elongated dimples to obtain maximum dimple coverage on the surface of the golf ball.

Oka et al., U.S. Pat. No. 5,338,039, discloses a golf ball having at least forty percent of its dimples with a polygonal shape. The shapes of the Oka golf ball are pentagonal, hexagonal and octagonal.

Although the prior art has set forth numerous variations for the surface of a golf ball, there remains a need for a golf ball having a surface that minimizes the volume needed to trip the boundary layer of air at low speed while providing a low drag level at high speeds.

BRIEF SUMMARY OF THE INVENTION

The present invention is able to provide a golf ball that meets the USGA requirements, and provides a minimum land area to trip the boundary layer of air surrounding a golf ball during flight in order to create the necessary turbulence for greater distance. The present invention is able to accomplish this by providing a golf ball with a tubular lattice pattern on a surface of an innersphere.

One aspect of the present invention is a golf ball with an innersphere having a surface and a plurality of pyramidal projections disposed on the innersphere surface. Each of the pyramidal projections has a cross-sectional contour with an apex at the greatest extent from the center of the golf ball. The plurality of pyramidal projections form a predetermined pattern on the surface. Each of the pyramidal projections extend from 0.005 inches to 0.010 inches from the innersphere surface.

The plurality of pyramidal projections on the golf ball may cover between 20% to 80% of the surface of the innersphere surface. The apex of each of the plurality of pyramidal projections may have a width less than 0.000001 inches. The diameter of the innersphere may be at least 1.67 inches and the height of the apex of each of the plurality of pyramidal projections may be at least 0.005 inches from the surface of the innersphere. The golf ball may also include a plurality of smooth portions on the innersphere surface wherein the plurality of smooth portions and the plurality of pyramidal projections cover the entire innersphere surface.

A further aspect of the present invention is a non-dimpled golf ball having a sphere and a plurality of pyramidal projections. The sphere has a diameter in the range of 1.60 to 1.70. The plurality of pyramidal projections extend outward from the sphere. Each of the projections has an apex that extends from a surface of the sphere in a range of 0.005 to 0.010. The entire surface of the golf ball is composed of the plurality of pyramidal projections and a plurality of smooth portions.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
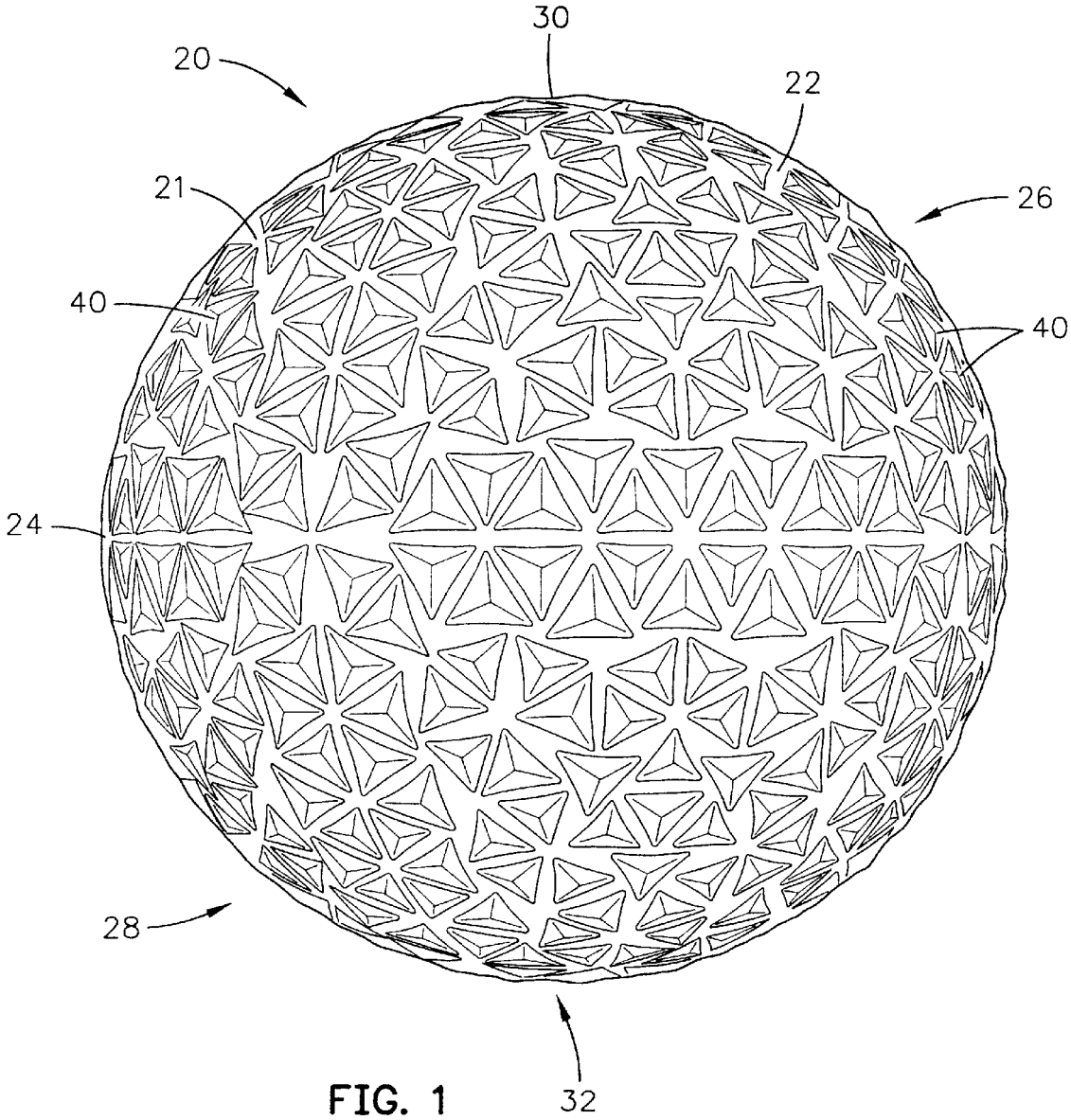
FIG. 1 is an equatorial view of a golf ball of the present invention.
Figure 2:
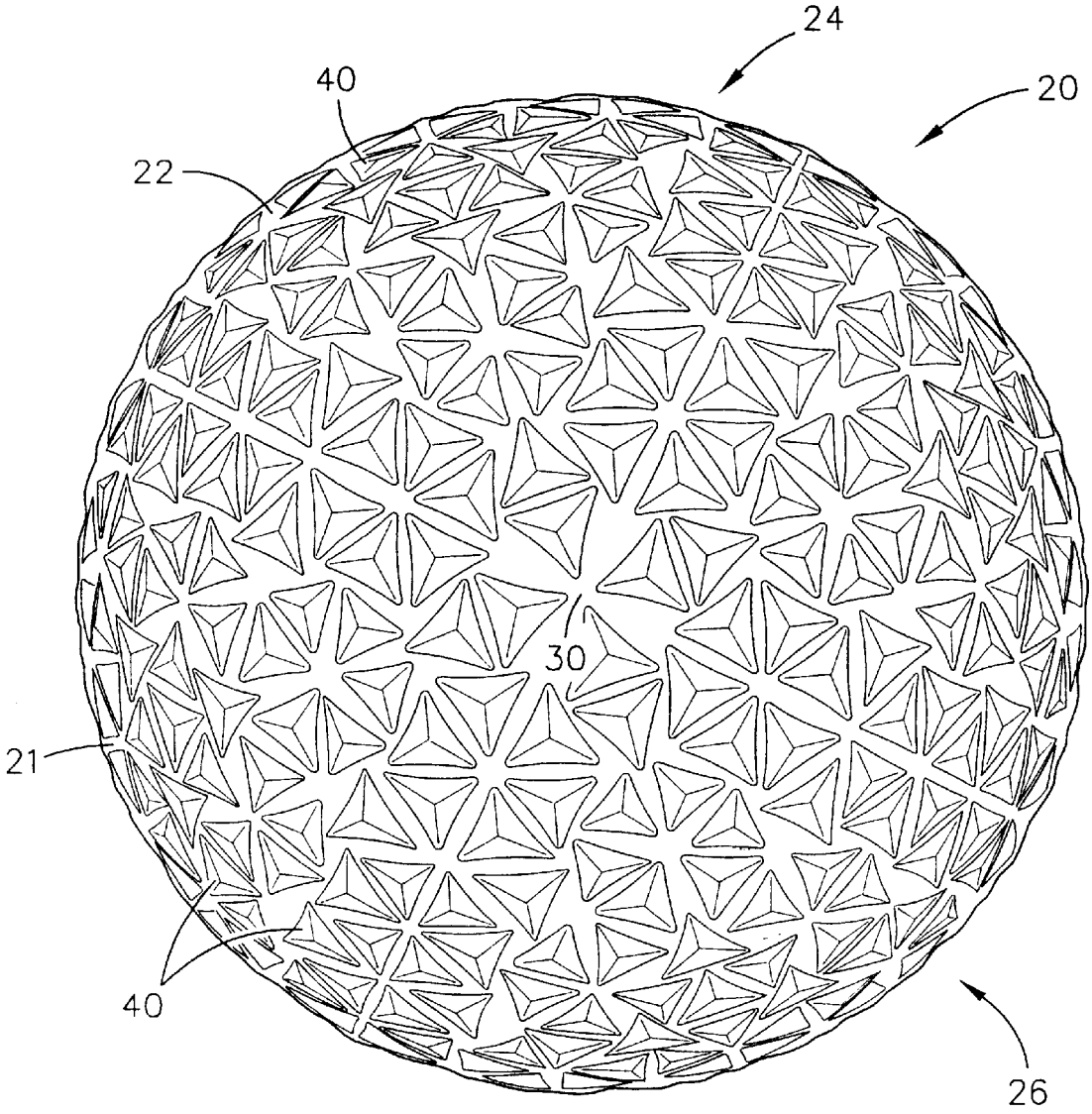
FIG. 2 is a polar view of the golf ball of FIG. 1.
Figure 3:
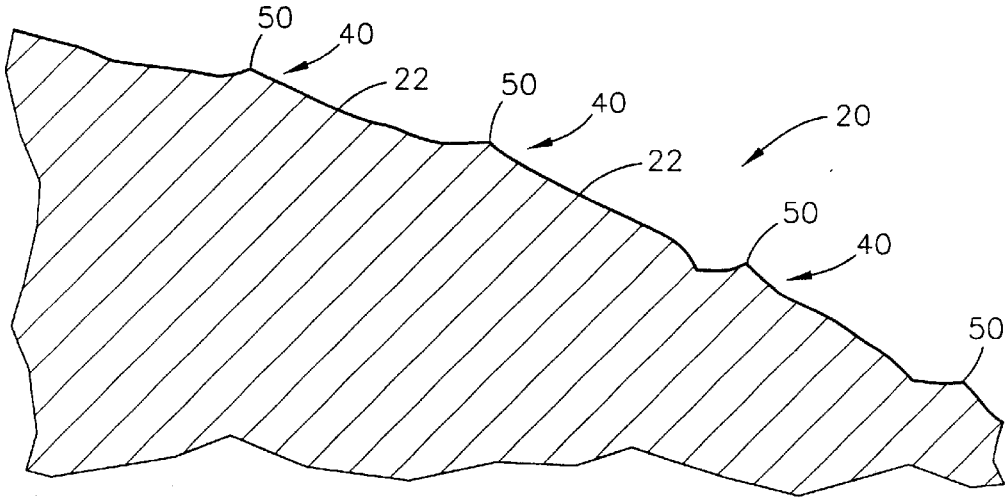
FIG. 3 is an enlargement of a section of FIG. 1.

As shown in FIGS. 1–3, a golf ball is generally designated 20. The golf ball may be a two-piece, a three piece golf ball, or a multiple layer golf ball. Further, the three-piece golf ball may have a wound layer, or a solid boundary layer. Additionally, the core of the golf ball 20 may be solid, hollow or filled with a fluid such as a gas or liquid. The cover of the golf ball 20 may be any suitable material. A preferred cover is composed of a thermoset polyurethane material. However, those skilled in the pertinent art will recognize that other cover materials may be utilized without departing from the scope and spirit of the present invention. The golf ball 20 may have a finish of a basecoat and/or top coat.

The golf ball 20 has a sphere 21 with an innersphere surface 22. The golf ball 20 also has an equator 24 dividing the golf ball 20 into a first hemisphere 26 and a second hemisphere 28. A first pole 30 is located ninety degrees along a longitudinal arc from the equator 24 in the first hemisphere 26. A second pole 32 is located ninety degrees along a longitudinal arc from the equator 24 in the second hemisphere 28.

Extending outward from the surface 22 of the innersphere 21 are a plurality of projections 40. In a preferred embodiment, the projections 40 are pyramidal projections. However, those skilled in the pertinent art will recognize that the projections 40 may have other similar shapes. The projections are connected to each other to form a unique pattern on the surface 22 of the innersphere 21. The apices 50 are the congruence of three sides 51*a*, 51*b* and 51*c* of the pyramidal structure.

Unlike traditional golf balls that attempt to minimize the land area (the non-dimpled area) by packing in various sizes of dimples, the preferred embodiment of the present invention has zero land area since only a line of each of the plurality of projections 40 is in a spherical plane at 1.68 inches. More specifically, the land area of traditional golf balls is the area forming a sphere of at least 1.68 inches for USGA and R&A conforming golf balls. This land area is minimized with dimples that are concave into the surface of the sphere of the traditional golf ball. However, the innersphere 21 of the golf ball 20 of the present invention has a diameter that is less than 1.68 inches. The golf ball 20 of the present invention conforms to the USGA and R&A 1.68 inches diameter requirement due to the height of the projections 40 from the surface 22 of the innersphere 21. The height of the projections 40 are such that the diameter of the golf ball 20 of the present invention meets or exceeds the 1.68 inches requirement. In a preferred embodiment, only a point at the apex of each of the projections 40 meets the 1.68 inches requirement.

Traditional golf balls were designed to have the dimples "trip" the boundary layer on the surface of a golf ball in flight to create a turbulent flow for greater lift and reduced drag. The golf ball 20 of the present invention has the plurality of projections 40 to trip the boundary layer of air about the surface of the golf ball 20 in flight.

Figure 4:
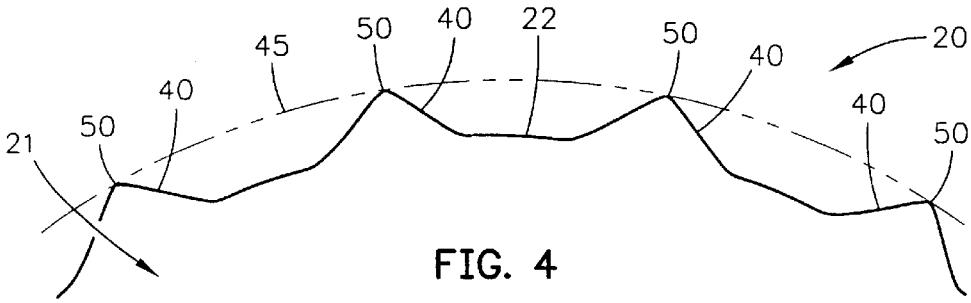
FIG. 4 is a cross-sectional view of the surface of the golf ball of the present invention illustrating a phantom sphere.

As shown in FIG. 4, a phantom 1.68 inches sphere, as shown by dashed line 45, encompasses the projections 40 and the innersphere 21. The volume of the projections 40 as measured from the surface 22 of the innersphere to the apex 50 is a minimal amount of the volume between the phantom 1.68 inches sphere and the innersphere 21. In the preferred embodiment, the apex 50 lies on the phantom 1.68 inches sphere. Thus, over 99 percent, and closer to 99.5 percent, of the entire surface of the golf ball 20 lies below the 1.68 inches phantom sphere.

Figure 5:
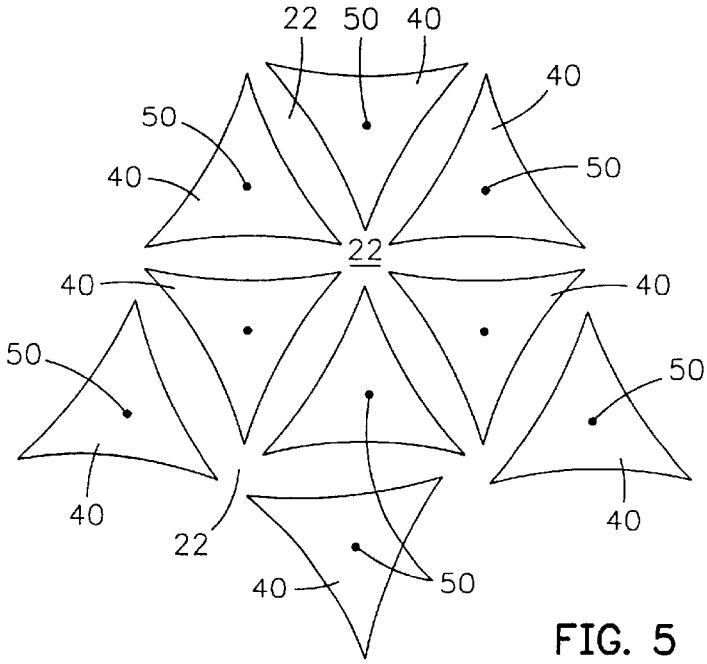
FIG. 5 is a top plan view of a section of the golf ball of the present invention to illustrate the apex of each of the pyramidal projections.

As shown in FIG. 5, the width of each of the apices 50 is minimal since the apex is a point. In theory, the width of each apex 50 should approach the width of a point. In practice, the width of each apex 50 of each projection 40 is determined by the precision of the mold utilized to produce the golf ball 20. The precision of the mold is itself determined by the master used to form the mold. In the practice, the width of each line ranges from 0.0001 inches to 0.001 inches.

Figure 6:
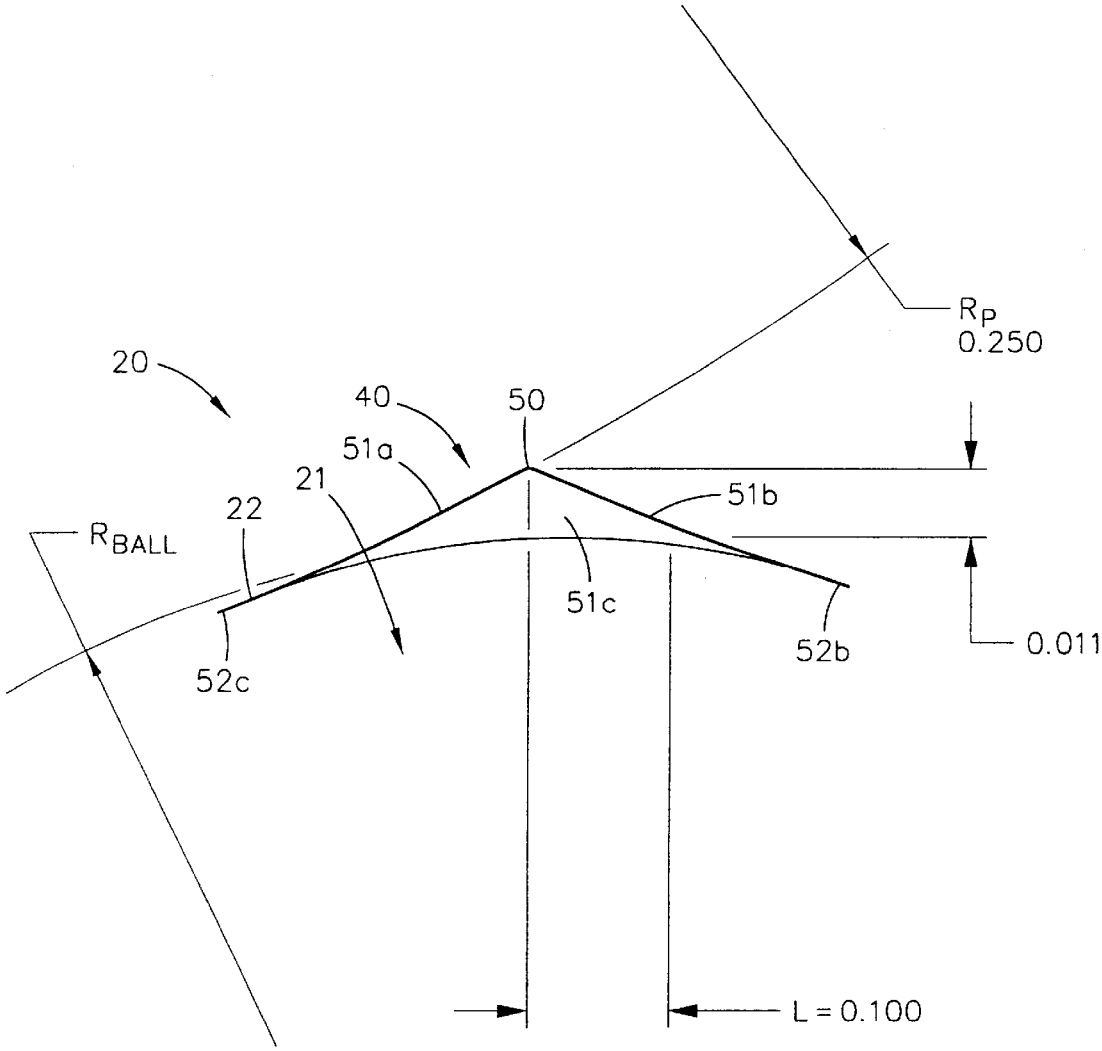
FIG. 6 is an isolated cross-sectional view of one embodiment of pyramidal projections extending outward from the surface of the innersphere of the golf ball of the present invention.
Figure 6A:
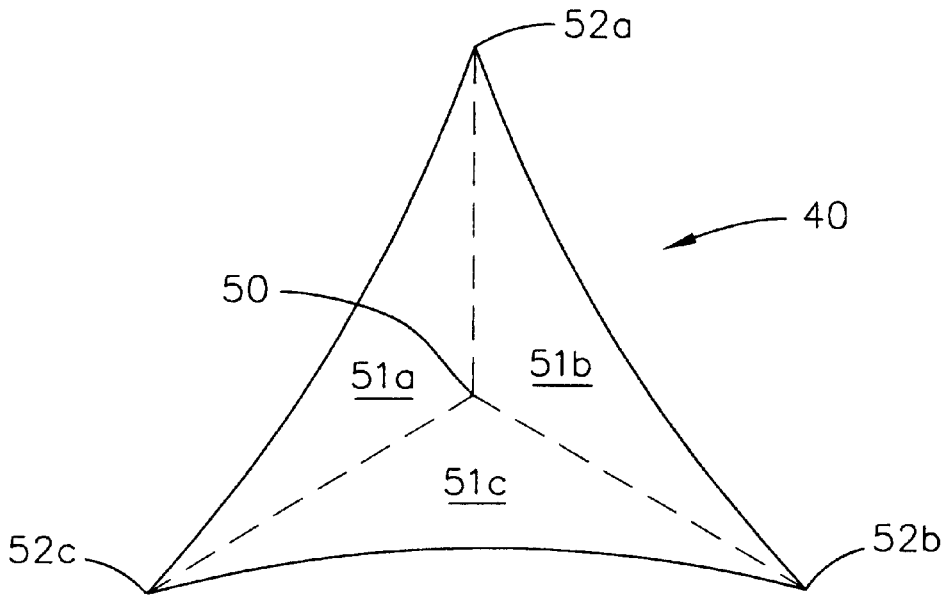
FIG. 6A is an isolated top plan view of the pyramidal projection of FIG. 6.
Figure 6B:
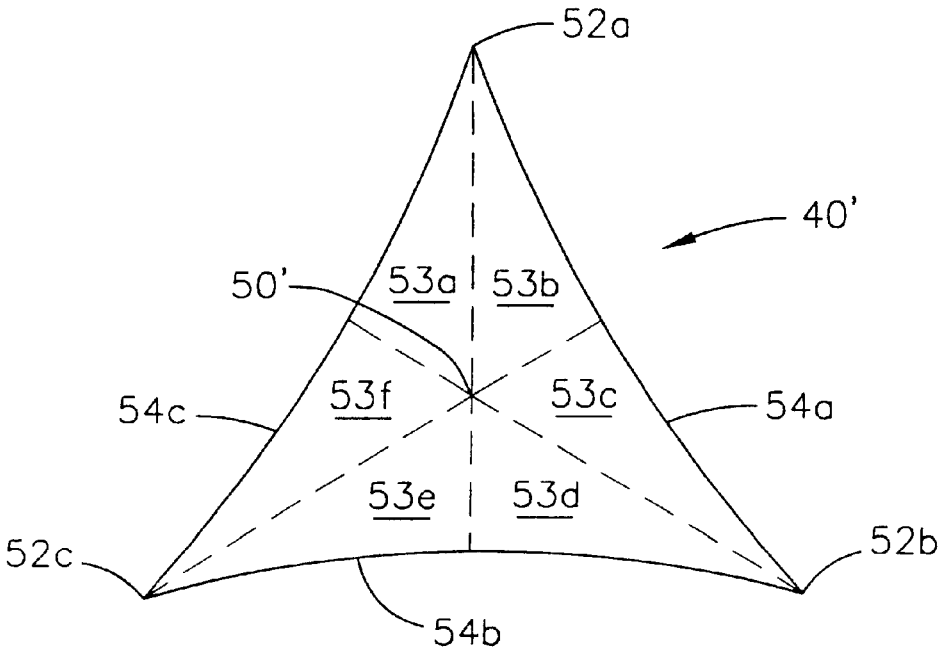
FIG. 6B is an isolated top plan view of an alternative embodiment of a pyramidal projection.

AS shown in FIGS. 6 and 6A, the radius $R_{ball}$ of the inner sphere is preferably in the range of 0.825 inches to 0.840 inches, and most preferably 0.831 inches. The radius $R_p$ of the sides 51*a*, 51*b* and 51*c* of each of the pyramidal projections is preferably in the range of 0.225 inches to 0.300 inches, and most preferably 0.250 inches. Each of the pyramidal projections 40 have three edge points 52*a*, 52*b* and 52*c* with the edge between each of the points 52*a–c* curved and equal to each other edge. Each side 51*a–c* is concave from the edge to the apex 50. In an alternative embodiment as shown in FIG. 6B, there are six sides 53*a–f* meeting at an apex 50'. Those skilled in the art will recognize that the pyramidal projections 40 may have a greater number of sides without departing from the scope and spirit of the present invention.

In an alternative embodiment, not shown, the golf ball 20 has a parting line 100 that is non-planar allowing for some of the plurality of pyramidal projections 40 to be disposed about the equator 24. The parting line 100 will alternate along edge points 51*a–c* of pyramidal projections 40. Such a golf ball 20 is fabricated using a mold such as disclosed in co-pending U.S. patent application No. 09/442,845, filed on Nov. 18, 1999, filed on an even date herewith, entitled Mold For A Golf Ball, and which is hereby incorporated herein by reference. This embodiment allows for greater uniformity of the pyramidal projections.

Figure 7:
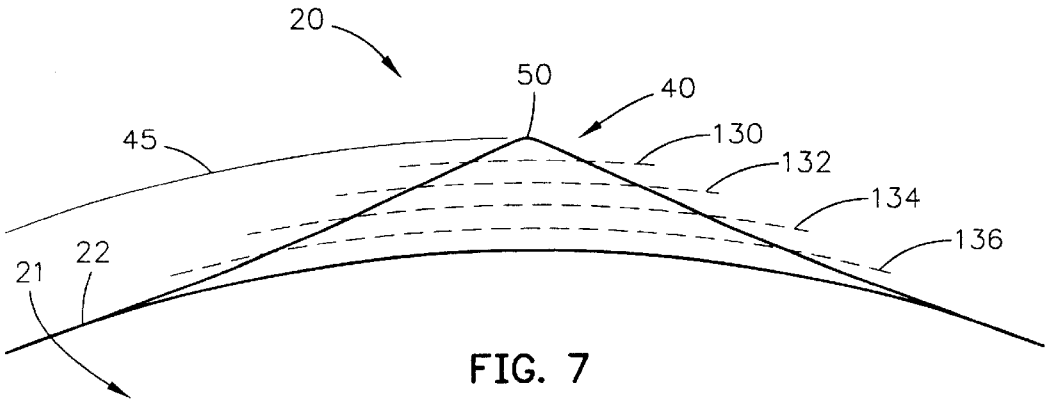
FIG. 7 is an enlarged view of the surface of a golf ball of the present invention to demonstrate the minimal volume feature of the present invention.

FIG. 7 is an enlarged view of the surface of the golf ball 20 of the present invention to demonstrate the minimal volume of the golf ball 20 from a predetermined distance from the greatest extent of the golf ball 20. More specifically, the greatest extent of one embodiment of the golf ball 20 are the apices 50 of the projections 40 which lie on a spherical plane (shown as dashed line 45) which has a 1.682 inches diameter. Those skilled in the art should recognize that other embodiments could have the apices 50 lie on a spherical plane at 1.70 inches, 1.72 inches, 1.64 inches, 1.60 inches, or any other variation in the diameter of the greatest extent of the golf ball 20. Having defined the greatest extent of the golf ball 20, the present invention will have a minimal volume from this greatest extent toward the innersphere 22. For example, dashed line 130 represents a spherical plane that intersects each of the projections 40 at a distance of 0.002 inches from the greatest extent of the golf ball 20. The volume of the golf ball 20 of the present invention between the greatest extent spherical plane 45 and the spherical plane 130 is only 0.0000667744 cubic inches. In other words, the outermost 0.002 inches of the golf ball 20 has a volume 0.0000667744 cubic inches.

Figure 8:
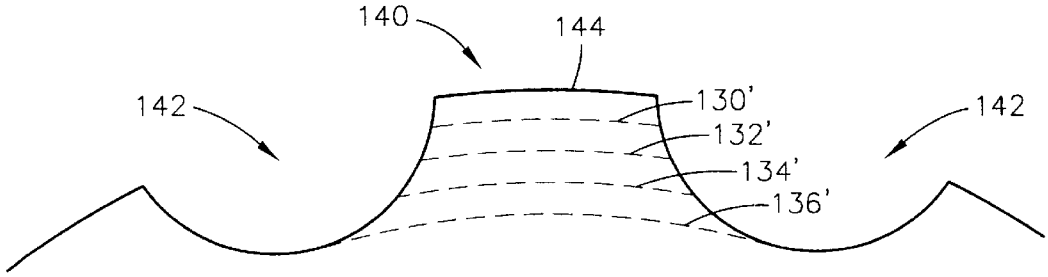
FIG. 8 (PRIOR ART)
FIG. 8 is an enlarged view of the surface of a golf ball of the prior art for comparison to the minimal volume feature of the present invention.

FIG. 8 illustrates the surface of a golf ball 140 of the prior art that has traditional dimples 142 encompassed by a land area 144. The land area 144 represents the greatest extent of the golf ball 140 of the prior art. For comparison to the golf ball 20 of the present invention, the volume of a high dimple coverage (>80%) golf ball 140 of the prior art between the greatest extent 144 and a spherical plane 130' is 0.00213 cubic inches. Spherical planes 132, 134 and 136, at 0.004 inches, 0.006 inches and 0.008 inches respectively, will have volumes of 0.00028248 cubic inches, 0.000655512 cubic inches and 0.00124696 cubic inches on the golf ball 20 of the present invention. While spherical planes 132', 134' and 136', at 0.004 inches, 0.006 inches and 0.008 inches respectively, will have volumes of 0.00498 cubic inches, 0.00841 cubic inches and 0.01238 cubic inches on the golf ball 140 of the prior art 140.

Thus, a golf ball 20 of the present invention will have a minimal volume at a predetermined distance from the greatest extent of the golf ball 20. This minimal volume is a minimal amount necessary to trip the boundary layer air at low speed while providing a low drag level at high speeds. Table One and Table Two

TABLE ONE

| Shell Delta Dia. | Volume-Lay1, 1 Delt | Number of lay1delt | Volume/tot lay1 |
|---|---|---|---|
| 0.001 | 2.75E-08 | 352 | 0.00000968 |
| 0.002 | 0.000000118 | 352 | 0.000041536 |
| 0.003 | 2.243E-07 | 352 | 7.89536E-05 |
| 0.004 | 0.000000426 | 352 | 0.000149952 |
| 0.005 | 0.000000685 | 352 | 0.00024112 |
| 0.006 | 0.00000114 | 352 | 0.00040128 |
| 0.007 | 0.00000151 | 352 | 0.00053152 |
| 0.008 | 0.00000211 | 352 | 0.00074272 |
| 0.009 | 0.00000296 | 352 | 0.00104192 |

TABLE TWO

| Shell Delta Dia. | Volume-Lay2,1delt | Number of lay2delt | Volume/tot lay2 | Total Resulting Volume |
|---|---|---|---|---|
| 0.001 | 1.79E-08 | 264 | 4.7256E-06 | 1.44056E-05 |
| 0.002 | 9.56E-08 | 264 | 2.52384E-05 | 6.67744E-05 |
| 0.003 | 0.000000221 | 264 | 0.000058344 | 0.000137298 |
| 0.004 | 0.000000502 | 264 | 0.000132528 | 0.00028248 |
| 0.005 | 0.000000648 | 264 | 0.000171072 | 0.00041292 |
| 0.006 | 0.000000963 | 264 | 0.000254232 | 0.000655512 |
| 0.007 | 0.00000139 | 264 | 0.00036696 | 0.00089848 |
| 0.008 | 0.00000191 | 264 | 0.00050424 | 0.00124696 |
| 0.009 | 0.00000261 | 264 | 0.00068904 | 0.00173096 |

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A golf ball comprising:

an innersphere having a surface, the radius of the innersphere ranging from 0.825 inch to 0.840 inch; and a plurality of pyramidal projections disposed on the innersphere surface, each of the pyramidal projections extending from 0.005 inch to 0.015 inch from the innersphere surface, each of the pyramidal projections having three concave sides, a radius of curvature for each concave sides ranging from 0.225 inch to 0.300 inch.

2. The golf ball according to claim 1 wherein the plurality of pyramidal projections cover between 20% to 80% of the surface of the innersphere surface.

3. The golf ball according to claim 1 wherein each of the plurality of pyramidal projections has an apex with a width less than 0.00001 inches.

4. The golf ball according to claim 3 wherein the diameter of the innersphere is at least 1.67 inches and the height of the apex of each of the plurality of pyramidal projections is at least 0.005 inches from the surface of the innersphere.

5. The golf ball according to claim 1 further comprising a plurality of smooth portions on the innersphere surface wherein the plurality of smooth portions and the plurality of pyramidal projections cover the entire innersphere surface.

6. A non-dimpled golf ball comprising:

a sphere having a diameter in the range of 1.60 inch to 1.76 inch;

a plurality of pyramidal projections extending outward from the sphere, each of the pyramidal projections having an apex that extends from a surface of the sphere in a range of 0.005 inch to 0.015 inch, each of the pyramidal projections having three or six concave sides, the radius of curvature of each of the concave sides ranging from 0.225 inch to 0.300 inch; and a plurality of smooth portions on the surface;

wherein the entire surface of the golf ball is composed of the plurality of pyramidal projections and the plurality of smooth portions.

7. The non-dimpled golf ball according to claim 8 wherein the apex of each of the plurality of pyramidal projections has a width less than 0.00001 inches.

8. The non-dimpled golf ball according to claim 6 wherein the diameter of the sphere is at least 1.67 inches and the height of the apex of each of the plurality of pyramidal projections is at least 0.005 inches from the surface of the sphere.

9. A golf ball comprising:

a surface having a plurality of pyramidal projections thereon, each of the pyramidal projections having three or six concave sides, the radius of curvature of each of the concave sides ranging from 0.225 inch to 0.300 inch, wherein an apex of at least one the plurality of pyramidal projections defines the greatest extent of the golf ball, wherein the volume of the outermost 0.002 inch of the golf ball is less than 0.00213 cubic inches.

10. The golf ball according to claim 9 wherein the volume of the outermost 0.004 inches of the golf ball is less than 0.00498 cubic inches.

11. The golf ball according to claim 9 wherein the volume of the outermost 0.006 inches of the golf ball is less than 0.00841 cubic inches.

12. The golf ball according to claim 9 wherein the volume of the outermost 0.008 inches of the golf ball is less than 0.001238 cubic inches.

13. The golf ball according to claim 9 further comprising:

a innersphere having a diameter in the range of 1.60 to 1.78; and a plurality of smooth portions on the surface of the innersphere;

wherein the entire surface of the golf ball is composed of the plurality of pyramidal projections and the plurality of smooth portions.

* * * * *